US012515868B2

(12) United States Patent
Wu et al.

(10) Patent No.: US 12,515,868 B2
(45) Date of Patent: Jan. 6, 2026

(54) PACKAGING ASSEMBLY FOR AN APPLIANCE

(71) Applicant: WHIRLPOOL CORPORATION, Benton Harbor, MI (US)

(72) Inventors: Ping Wu, Shenzhen (CN); Song Zhao, Shenzhen (CN); Lingling Zheng, Shenzhen (CN); Hui Wu, Shenzhen (CN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 67 days.

(21) Appl. No.: 18/007,543

(22) PCT Filed: Jun. 2, 2020

(86) PCT No.: PCT/CN2020/093879

§ 371 (c)(1),
(2) Date: Dec. 1, 2022

(87) PCT Pub. No.: WO2021/243548

PCT Pub. Date: Dec. 9, 2021

(65) Prior Publication Data

US 2023/0249892 A1 Aug. 10, 2023

(51) Int. Cl.
*B65D 85/68* (2006.01)
*B65D 81/05* (2006.01)

(52) U.S. Cl.
CPC ..... *B65D 81/058* (2013.01); *B65D 85/68* (2013.01); *B65D 2581/055* (2013.01); *B65D 2581/056* (2013.01); *B65D 2585/6815* (2013.01)

(58) Field of Classification Search
CPC .. B65D 2585/6812; B65D 2519/00815; B65D 81/107; B65D 81/113;
(Continued)

(56) References Cited

U.S. PATENT DOCUMENTS 3,012,688 A * 12/1961 Hine ..... B65D 85/68 217/36
3,997,074 A * 12/1976 Shead ..... B65D 1/243 220/644

(Continued)

FOREIGN PATENT DOCUMENTS

CN 101195433 A 6/2008
CN 201169439 Y * 12/2008

(Continued)

*Primary Examiner* — Allan D Stevens
(74) *Attorney, Agent, or Firm* — Price Heneveld LLP

(57) ABSTRACT

A packaging assembly (10) for an appliance (14) includes a first shock-absorbing member (18) that defines a cavity (22) to receive atop (26) of the appliance (14) and a second shock-absorbing member (42). The first shock-absorbing member (18) defines a first groove (30) and a second groove (34). Each of the first groove (30) and second groove (34) is defined in a top surface (38) of the first shock-absorbing member (18) and extends along a length thereof. The second shock-absorbing member (42) defines a recess (46) to receive a bottom (50) of the appliance (14). The first shock-absorbing member (18) and the second shock-absorbing member (42) are configured to retain the appliance (14). A first support feature (54) is disposed within the first groove (30) of the first shock-absorbing member (18). A second support feature (58) is disposed within the second groove (34) of the first shock-absorbing member (18). Each of the first support feature (54) and the second support feature (58) is constructed of a wood plastic composite.

20 Claims, 6 Drawing Sheets

(58) Field of Classification Search
CPC .. B65D 81/127; B65D 81/133; B65D 81/053; B65D 81/054; B65D 81/055; B65D 81/056; B65D 81/057; B65D 81/058; B65D 85/68; B65D 2585/6817; B65D 2585/6855; B65D 2501/24554; B65D 2501/24802; B65D 2501/24821; B65D 2501/2484
See application file for complete search history.

(56) References Cited

U.S. PATENT DOCUMENTS

| | | | | | |
|---|---|---|---|---|---|
| 4,688,890 | A * | 8/1987 | DeMeo | G02B 6/50 | 385/100 |
| 5,868,080 | A * | 2/1999 | Wyler | B65D 19/0026 | 108/57.25 |
| 6,155,419 | A * | 12/2000 | Sowa | B65D 75/004 | 206/320 |
| 6,161,715 | A * | 12/2000 | Stolzman | B65D 19/18 | 220/653 |
| 6,915,603 | B2 | 7/2005 | Hunt | | |
| 8,505,467 | B1 | 8/2013 | Roberts et al. | | |
| 8,561,801 | B2 | 10/2013 | Grenchus, Jr. et al. | | |
| 10,232,540 | B2 | 3/2019 | Guillemette et al. | | |
| 10,233,011 | B1 | 3/2019 | Estill | | |
| 10,246,212 | B2 | 4/2019 | Beck | | |
| 10,435,232 | B2 | 10/2019 | Hokanson et al. | | |
| 2002/0179469 | A1* | 12/2002 | Tornga | B65D 81/056 | 206/320 |
| 2008/0256777 | A1* | 10/2008 | Dubois | B65D 19/0018 | 108/57.31 |
| 2009/0178595 | A1* | 7/2009 | Chen | B65D 19/0095 | 108/57.25 |
| 2012/0031807 | A1 | 2/2012 | Shimomichi | | |
| 2014/0332432 | A1* | 11/2014 | Zhou | B65D 85/48 | 206/523 |
| 2015/0240516 | A1* | 8/2015 | Bertato | E04H 17/1447 | 256/65.03 |
| 2015/0284540 | A1* | 10/2015 | Kosonen | B29C 48/41 | 524/13 |
| 2020/0062487 | A1* | 2/2020 | Gehlhausen | F17C 3/04 | |
| 2020/0130923 | A1* | 4/2020 | Lv | B65D 85/38 | |
| 2021/0039834 | A1* | 2/2021 | Cheng | B65D 81/113 | |

FOREIGN PATENT DOCUMENTS

| | | | | | |
|---|---|---|---|---|---|
| CN | 201351012 | Y | | 11/2009 | |
| CN | 206395178 | U | | 8/2017 | |
| CN | 208412657 | U | | 1/2019 | |
| CN | 109625531 | A | * | 4/2019 | B65D 11/22 |
| CN | 218349009 | U | * | 1/2023 | |
| EP | 2431298 | B1 | | 3/2012 | |
| EP | 2781463 | A1 | | 9/2014 | |
| GB | 1580018 | A | | 11/1980 | |
| JP | 2006001576 | A | | 1/2006 | |
| JP | 2011157128 | A | | 8/2011 | |
| KR | 200316745 | Y1 | * | 6/2003 | |
| WO | 2014183319 | A1 | | 11/2014 | |

* cited by examiner

PACKAGING ASSEMBLY FOR AN APPLIANCE

BACKGROUND OF THE DISCLOSURE

The present disclosure generally relates to a packaging assembly, and more specifically, to a packaging assembly for an appliance.

SUMMARY OF THE DISCLOSURE

According to one aspect of the present disclosure, a packaging assembly for an appliance includes a first shock-absorbing member that defines a cavity to receive a top of the appliance. The first shock-absorbing member defines a first groove and a second groove. Each of the first groove and second groove is defined in a top surface of the first shock-absorbing member and extend along a length thereof. A second shock-absorbing member defines a recess to receive a bottom of the appliance. The first shock-absorbing member and the second shock-absorbing member are configured to retain the appliance. A first support feature is disposed within the first groove of the first shock-absorbing member. A second support feature is disposed within the second groove of the first shock-absorbing member. Each of the first support feature and the second support feature is constructed of a wood plastic composite.

According to another aspect of the present disclosure, a packaging assembly includes a shock-absorbing member that defines a first groove along a first edge and a second groove along a second edge. Each of the first groove and the second groove extend along a length of the shock-absorbing member. The shock-absorbing member defines a cavity for receiving an appliance. A first support feature is disposed within the first groove. A second support feature is disposed within the second groove. The first support feature and the second support feature are constructed of a wood plastic composite.

According to yet another aspect of the present disclosure, a method of packaging an appliance includes extruding a plurality of support features arranged in a parallel configuration. Adjacent support features are coupled together by a connector. The plurality of support features is separated into individual support features. A shock-absorbing member that defines a groove is provided. An individual support feature is positioned within the groove.

These and other features, advantages, and objects of the present disclosure will be further understood and appreciated by those skilled in the art by reference to the following specification, claims, and appended drawings.

Figure 1:
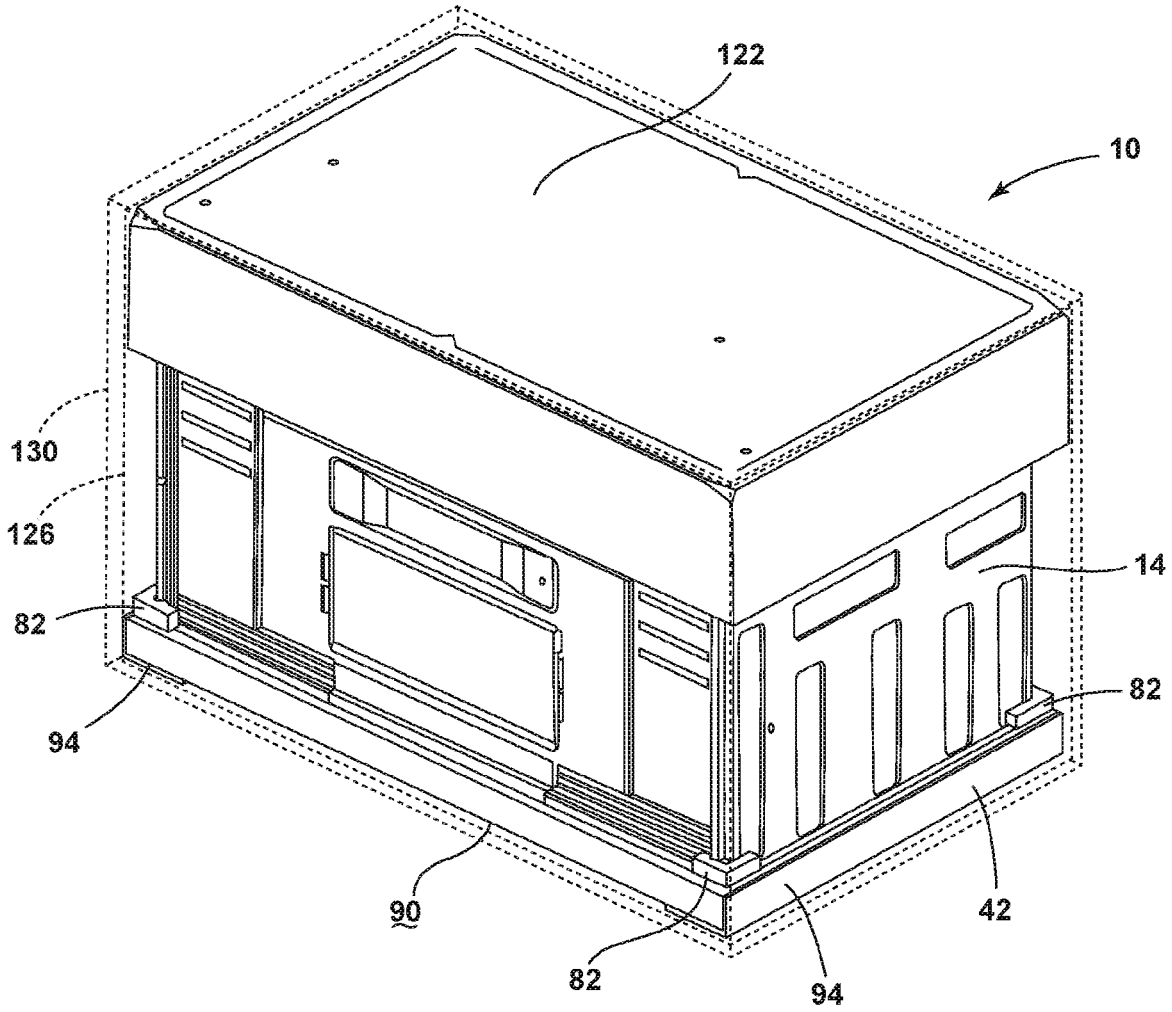
FIG. 1 is a side perspective view of an appliance positioned within a packaging assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a packaging assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates a packaging assembly for an appliance 14 that includes a first shock-absorbing member 18 that defines a cavity 22 to receive a top 26 of the appliance 14. The first shock-absorbing member 18 defines a first groove 30 and a second groove 34. Each of the first groove 30 and the second groove 34 are defined in a top surface 38 of the first shock-absorbing member 18 and extend along a length of the first shock-absorbing member 18. A second shock-absorbing member 42 defines a recess 46 to receive a bottom 50 of the appliance 14. The first shock-absorbing member 18 and the second shock-absorbing member 42 are configured to retain the appliance 14. A first support feature 54 is disposed within the first groove 30 of the first shock-absorbing member 18. A second support feature 58 is disposed within the second groove 34 of the first shock-absorbing member 18. Each of the first support feature 54 and the second support feature 58 are constructed of a wood plastic composite (WPC).

Figure 2:
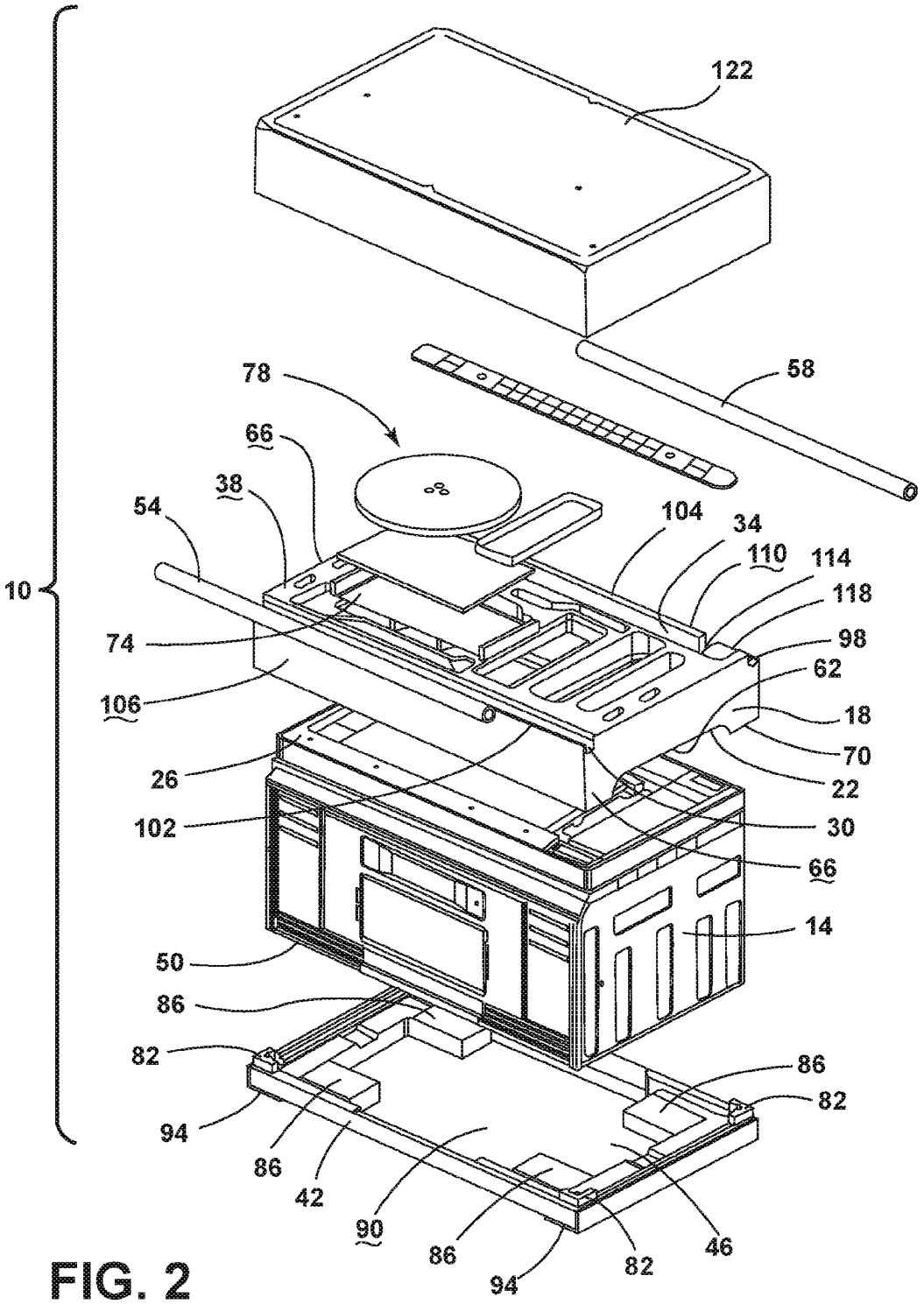
FIG. 2 is an exploded view of a packaging assembly for an appliance, according to the present disclosure.

Referring to FIGS. 1 and 2, the packaging assembly 10 is configured to support the appliance 14 during shipment and/or distribution processes. The appliance 14 is supported and retained between the first shock-absorbing member 18 and the second shock-absorbing member 42. The first shock-absorbing member 18 defines the cavity 22 to receive the top 26 of the appliance 14. Accordingly, the top 26 of the appliance 14 can be at least partially surrounded by the first shock-absorbing member 18. The second shock-absorbing member 42 defines the recess 46 for receiving the bottom 50 of the appliance 14. As illustrated, the recess 46 has a lesser depth than the cavity 22, however, other configurations are contemplated without departing from the teachings herein. The bottom 50 of the appliance 14 may be disposed at least partially within the recess 46 to rest on the second shock-absorbing member 42.

As illustrated in FIGS. 1 and 2, the appliance 14 is illustrated as a microwave oven. However, the packaging assembly 10 may be utilized with any of a variety of appliances without departing from the teachings herein. For example, the packaging assembly 10 is configured for use with microwave ovens, refrigerators, freezers, coolers, ovens, dishwashers, water heaters, air conditioners, and other similar appliances and/or fixtures within household and commercial settings. The size and configuration of the packaging assembly 10 can differ based on the specific appliance 14 retained within the packaging assembly 10.

Each of the first shock-absorbing member 18 and the second shock-absorbing member 42 may be constructed of any material configured to absorb a force acting on the packaging assembly 10. For example, the first shock-absorbing member 18 and/or the second shock-absorbing member 42 may be constructed of polystyrene (e.g., Styrofoam), other foam materials, and/or a combination thereof. According to various aspects, each of the first shock-absorbing member 18 and the second shock-absorbing member 42 have a length and a width greater than a length and a width of the appliance 14. This configuration may allow the packaging assembly 10 to at least partially surround the appliance 14. Accordingly, in some instances, it is intended that the first shock-absorbing member 18 and the second shock-absorbing member 42 can be an initial point of contact for a force acting on the packaging assembly 10, thereby reducing the force that acts directly on the appliance 14. The force can be at least partially absorbed by the first shock-absorbing member 18 and the second shock-absorbing member 42.

Referring still to FIGS. 1 and 2, the first shock-absorbing member 18 may define at least one indent 62 on an end surface 66 thereof. The end surface 66, as illustrated, extends the width of the first shock-absorbing member 18. The indent 62 extends from a bottom edge 70 toward the top surface 38 of the first shock-absorbing member 18. The indent 62 can be configured as a grasping location for a user to grasp the first shock-absorbing member 18 and remove the first shock-absorbing member 18 from the appliance 14. It is contemplated that one or both of the opposing end surfaces 66 of the first shock-absorbing member 18 may define the indent 62.

The top surface 38 of the first shock-absorbing member 18 defines one or more receiving spaces 74. The receiving spaces 74 may be any practicable size and/or shape. Detachable and/or separate appliance components or accessories 78 may be positioned within the receiving spaces 74 and supported at least partially by the first shock-absorbing member 18. This arrangement can protect the appliance accessories 78 during the shipment and/or distribution processes. The receiving spaces 74 may be depressions or recesses formed in the top surface 38, or alternatively, may extend at least partially through the first shock-absorbing member 18.

Referring still to FIGS. 1 and 2, the appliance 14 can be retained between the first shock-absorbing member 18 and the second shock-absorbing member 42. The second shock-absorbing member 42 defines the recess 46 which receives the bottom 50 of the appliance 14. The second shock-absorbing member 42 includes one or more retaining features 82 extending therefrom. As illustrated in FIGS. 1 and 2, the retaining features 82 are disposed proximate the corners of the second shock-absorbing member 42 and are configured to receive corner edges of the appliance 14. The retaining features 82 may assist in properly aligning the appliance 14 with the second shock-absorbing member 42. Additionally, the retaining features 82 may be advantageous for retaining the appliance 14 in the selected position within the recess 46.

The second shock-absorbing member 42 may include one or more platforms 86 disposed within the recess 46. As illustrated, one platform 86 can be disposed proximate each retaining feature 82. The platforms 86 can extend from a bottom surface 90 of the second shock-absorbing member 42. The appliance 14 can rest on the platforms 86. In this way, the appliance 14 can be spaced-apart from the bottom surface 90. The platforms 86 are configured to generally increase the shock-absorption properties of the packaging assembly 10.

The packaging assembly 10 can include elongated members 94 coupled to the second shock-absorbing member 42. As illustrated, the packaging assembly 10 includes two elongated members 94 extending along opposing sides of the second shock-absorbing member 42 in a width direction. The elongated members 94 can provide increased shock-absorption properties to the packaging assembly 10. The elongated members 94 can have a variety of configurations. For example, the elongated members 94 can be L-shaped extending along the bottom surface 90 and the opposing side surfaces 106, 110 of the second shock-absorbing member 42, as illustrated in FIG. 1. Additionally or alternatively, the elongated members 94 can be flat, panel-like components disposed under the second shock-absorbing member 42 adjacent to the bottom surface 90 thereof, as illustrated in FIG. 2. The elongated members 94 can be constructed of any practicable material, such as, for example, plastics, foams, cardboards, papers, other similar materials, and/or a combination thereof.

Figure 3:
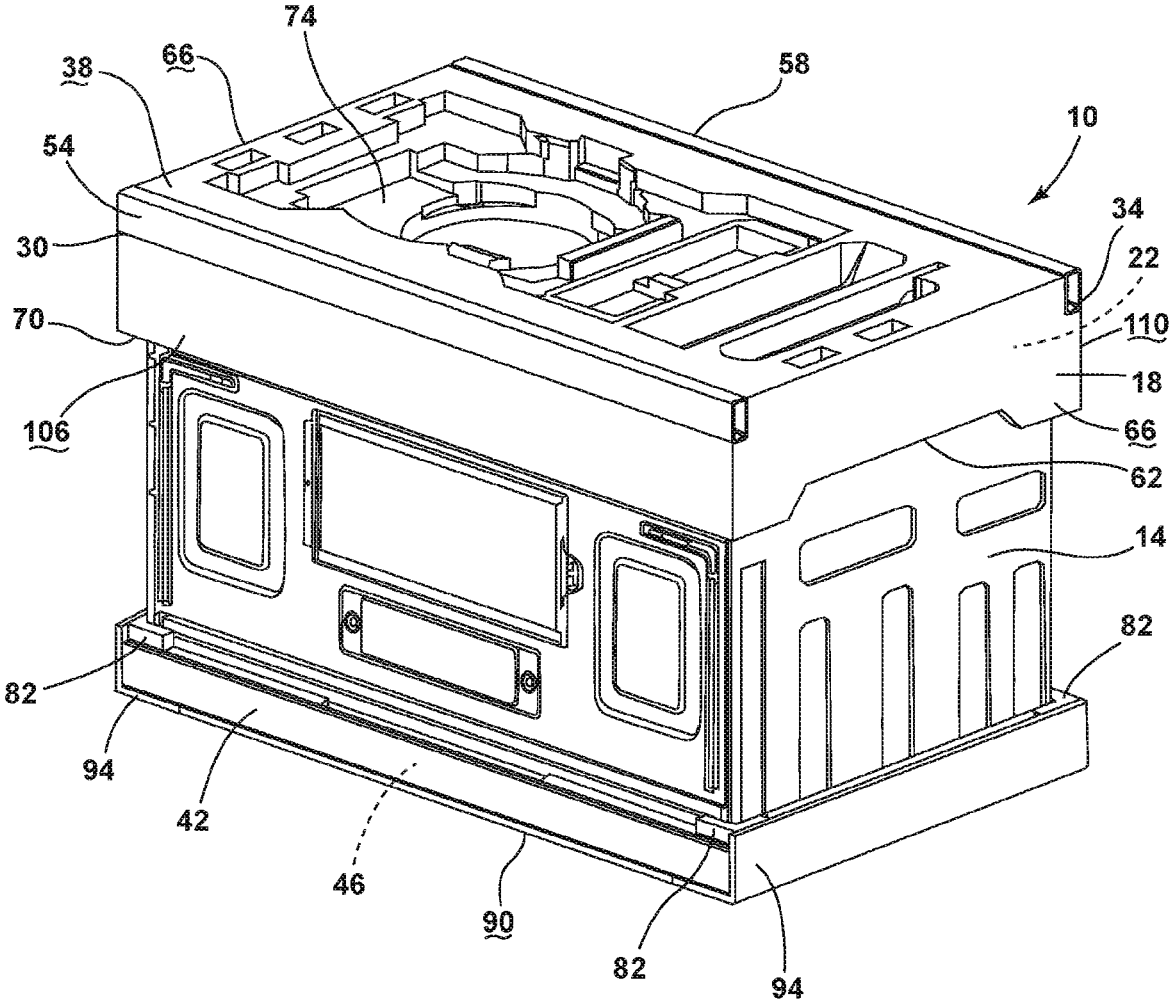
FIG. 3 is a side perspective view of an appliance positioned within a packaging assembly, according to the present disclosure.

Referring to FIGS. 2 and 3, the first shock-absorbing member 18 defines the first groove 30 and the second groove 34. Each of the first and second grooves 30, 34 extend at least a portion of the length of the first shock-absorbing member 18. As illustrated in FIG. 2, one or both of the first and second grooves 30, 34 may extend a substantial portion of the length of the first shock-absorbing member 18 with a bumper 98 being disposed at an end of at least one or both of the first and second grooves 30, 34. The bumper 98 can be an extension of the top surface 38 and one of the end surfaces 66 of the first shock-absorbing member 18. Additionally or alternatively, both of the first and second grooves 30, 34 can extend the entire length of the first shock-absorbing member 18, as illustrated in FIG. 3.

Referring to FIGS. 2 and 3, each of the first and second grooves 30, 34 are defined in the top surface 38 of the first shock-absorbing member 18. The first and second grooves 30, 34 can have a variety of configurations based on the size and cross-sectional shape of the first and second support features 54, 58 configured to be disposed therein. Moreover, the first groove 30 extends along a first edge of the first shock-absorbing member 18 parallel to the second groove 34 that extends along a second opposing edge, which may be advantageous for providing similar shock-absorbing properties to both sides of the appliance 14.

As illustrated in FIG. 2, each of the first and second support features 54, 58 have a substantially circular and/or oblong cross-sectional shape. The first groove 30 and the second groove 34 can be sized and shaped to accommodate the first and second support feature 54, 58. Accordingly, as illustrated in FIG. 2, each of the first and second grooves 30, 34 are substantially rounded or U-shaped to correspond with the cross-sectional shape of the respective first and second support features 54, 58 to form the rounded or U-shape, the first shock-absorbing member 18 may have a raised edge 102, 104 disposed adjacent to each of the first and second grooves 30, 34. The raised edges 102, 104 can operate to retain the first and second support features 54, 58 within the first and second grooves 30, 34, respectively.

One of the raised edges 104 may extend a portion of the length of the first shock-absorbing member 18, while the other raised edge 102 extends the entire length of the first shock-absorbing member 18. In a non-limiting example, the bumper 98 is disposed adjacent to the end after the second groove 34. The raised edge 104 disposed proximate the second groove 34 can define a gap 114 between the raised edge 104 and the bumper 98. A flange 118 extends from the first shock-absorbing member 18 adjacent to the gap 114 in a manner substantially parallel with the top surface 38. The gap 114 and the flange 118 may provide increased access to place the second shock-absorbing member 42 within the second groove 34 and/or remove the second support feature 58 therefrom. It is contemplated that a similar construction may be included with respect to the first groove 30.

The first and second grooves 30, 34 may be defined in any practicable location and/or arrangement relative to one another. For example, as illustrated in FIGS. 2 and 3, the first and second grooves 30, 34 can be disposed adjacent to opposing side surfaces 106, 110, of the first shock-absorbing member 18. Accordingly, the first groove 30 can extend along a first edge and the second groove 34 can extend along a second opposing edge in the length direction.

As illustrated in FIG. 3, the first shock-absorbing member 18 may be free of the raised edges 102, 104. In such configurations, each of the first and second grooves 30, 34 can be defined by the top surface 38 and one of the side surfaces 106, 110. The first and second grooves 30, 34 extend the entire length of the first shock-absorbing member 18 in such configurations. In a non-limiting example, the first and second support features 54, 58 can have a substantially rectangular cross-sectional shape. Accordingly, the first and second grooves 30, 34 can define an L-shaped extending surface between the top surface 38 and the corresponding side surface 106, 110 to accommodate the first and second support features 54, 58.

In various examples, each of the first and second support features 54, 58 may be substantially flush with the top surface 38 of the first shock-absorbing member 18 to provide a continuous surface. Additionally, the first support feature 54 can be substantially flush with the side surface 106, and the second support feature 58 can be substantially flush with the opposing side surface 110. This configuration provides flat surfaces such that a cover 122 (FIG. 2) can be disposed over the first shock-absorbing member 18. The raised edges 102, 104 may also be used when the first and second support features 54, 58 have the rectangular cross-sectional shape or any other cross-sectional shape.

Referring to FIGS. 1-3, the packaging assembly 10 can include the cover 122. The cover 122 is configured to be disposed over the first shock-absorbing member 18, as well as, both of the first and second support features 54, 58 when the first and second support features 54, 58 are disposed within the respective first and second grooves 30, 34. The cover 122 may be configured to retain the first and second support features 54, 58 within the first and second grooves 30, 34. The cover 122 may be advantageous for retaining the first and second support features 54, 58 when the first shock-absorbing member 18 is free of the raised edges 102, 104. The cover 122 may also provide additional shock-absorption properties to the packaging assembly 10. The cover 122 may have any practicable shape to be disposed over the first shock-absorbing member 18. Moreover, the cover 122 can be constructed of any practicable material, such as, for example, foams, plastics, cardboards, papers, any other similar materials, and/or a combination thereof.

The packaging assembly 10 may include a flexible membrane 126. The flexible membrane 126 can be disposed around the first and second shock-absorbing members 18, 42, the appliance 14, and the cover 122. The flexible membrane 126 may be constructed of thin, flexible materials, such as, for example, high-density polyethylene, low-density polyethylene, linear low-density polyethylene, other similar materials, and/or a combination thereof. Space can be defined between the flexible membrane 126 and the first and/or second shock-absorbing members 18, 42. Alternatively, the flexible membrane 126 may be sized and/or adjusted to form fit around the first and second shock-absorbing members 18, 42 and/or the appliance 14. The flexible membrane 126 is configured to assist in retaining the cover 122 and the first and second shock-absorbing members 18, 42 in position relative to the appliance 14.

Referring again to FIGS. 1-3, the combination of the appliance 14 and the packaging assembly 10 can be positioned within a shipping receptacle 130. The shipping receptacle 130 is typically constructed of cardboard or other paper materials. The shipping receptacle 130 can be the final packaging component for the appliance 14 before the shipment and/or distribution processes. The packaging assembly 10 can form a frictional engagement with the shipping receptacle 130 to reduce movement of the packaging assembly 10, and therefore, the appliance 14 within the shipping receptacle 130. The shipping receptacle 130 can provide additional shock-absorbency properties for the appliance 14. Additionally, the shipping receptacle 130 often includes images relating to the appliance 14 and the manufacturer thereof.

Figure 4:
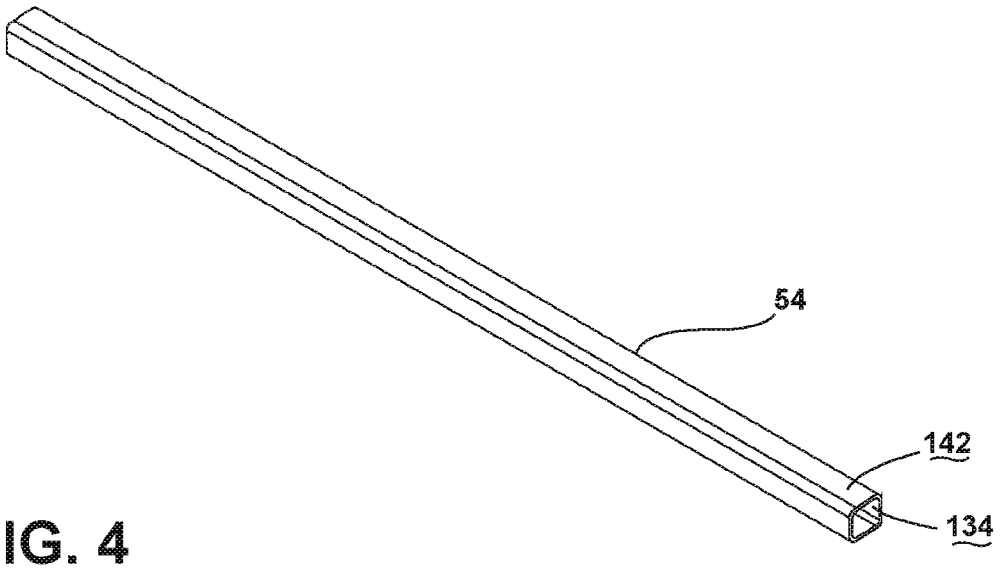
FIG. 4 is a side perspective view of a support feature of a packaging assembly, according to the present disclosure.

Referring to FIGS. 2 and 4, the first support feature 54 is illustrated separated from the first shock-absorbing member 18 (FIG. 2). The first support feature 54 is constructed of a WPC. The WPC can include one or more of a polymer resin, a wood fiber or a biomass filling, a mineral filling, and an additive. The specific composition of the WPC can depend on the packaging assembly 10, the appliance 14, the materials available, other aspects of the shipping and/or distribution processes, and/or a combination thereof. Moreover, the specific composition may be determined based on selected properties of the first and second support features 54, 58.

According to various aspects, the polymer resin may be new or recycled material. Additionally, the polymer resin can be, for example, one or more of polyethylene, high-density polyethylene, polyvinyl chloride, polypropylene, acrylonitrile butadiene styrene, and/or other plastic materials. The wood fiber or biomass filling can be, for example, one or more of a fiber, powder, or sawdust from fiber fillers. The fiber fillers can include, for example, pulp, peanut hulls, bamboo, straw, other wood materials, and/or a combination thereof. The mineral filling can be at least one of a calcium carbonate, a talcum powder, and/or a combination thereof. The additive can be at least one of an antioxidant, a plasticizer, a coupling agent, a color powder, and/or any combination thereof.

The composition of the WPC totals 100% with the polymer resin, the wood fiber biomass filling, the mineral filling, and the additive forming percentages of the total composition. In a non-limiting example, the WPC can include a range of from about 25% to about 40% of the polymer resin. The WPC can include a range of from about 40% to about 70% of the wood fiber biomass filling. Additionally or alternatively, the WPC can include a range of from about 0% to about 20% of the mineral filling. The WPC can include a range of from about 1% to about 5% of the additive. The specific composition of the WPC can differ based on the configuration of the packaging assembly 10, the appliance 14, the selected properties of the first and second support features 54, 58, the available materials to be included in the WPC, and/or a combination thereof.

Referring still to FIG. 4, the first support feature 54, as illustrated, is substantially hollow. The entire length of the first support feature 54 can be hollow. Alternatively, all or portions of the first support feature 54 may be solid or filled. The first support feature 54 can define a variety of cross-sectional shapes, which may differ based on the selected properties of the first support feature 54 and/or other aspects of the packaging assembly 10 (FIG. 1).

Figure 5A:
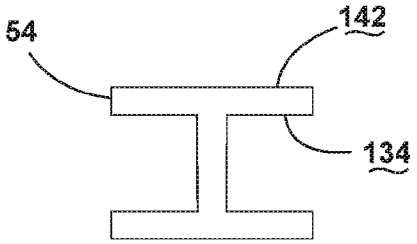
FIG. 5A is a side elevational cross-sectional view of a support feature of a packaging assembly, according to the present disclosure.

Referring to FIGS. 2 and 5A-5D, the first support feature 54 can define a variety of cross-sectional shapes, which may differ based on the selected properties of the first support feature 54 and/or other aspects of the packaging assembly 10. In a non-limiting example, as illustrated in FIG. 5A, the first support feature 54 defines a substantially I-shaped cross-sectional shape (e.g., with upper and lower horizontal portions and a vertical portion extending therebetween). A lower portion of the I-shape can be disposed on the first shock-absorbing member 18 within the first groove 30, while the upper portion of the I-shape can be substantially flush with the top surface 38 of the first shock-absorbing member 18.

Figure 5B:
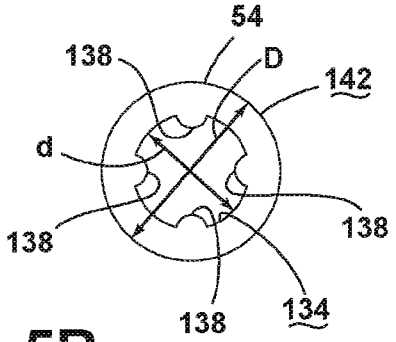
FIG. 5B is a side elevational cross-sectional view of a support feature of a packaging assembly, according to the present disclosure.
Figure 5C:
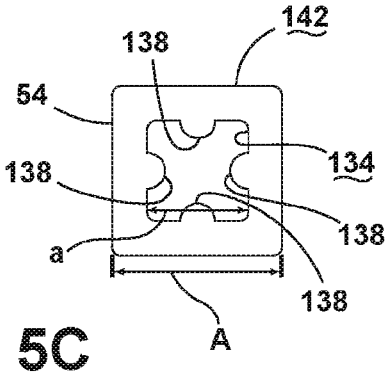
FIG. 5C is a side elevational cross-sectional view of a support feature of a packaging assembly, according to the present disclosure.
Figure 5D:
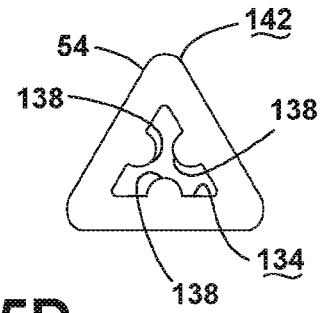
FIG. 5D is a side elevational cross-sectional view of a support feature of a packaging assembly, according to the present disclosure.

Referring to FIGS. 5B-5D, in additional or alternative non-limiting examples, the first support feature 54 defines a geometric cross-sectional shape, such as a circle (FIG. 5B), a square (FIG. 5C), or a triangle (FIG. 5D). It is contemplated that the first support feature 54 can define any geometric or irregular cross-sectional shape. An inner surface 134 of the first support feature 54 can define one or more ribs 138. The ribs 138 can be integrally formed with the first support feature 54, or alternatively, can be separate components coupled to the inner surface 134. The first support feature 54 can include any number of ribs 138. The ribs 138 extend along the length of the first support feature 54. The ribs 138 can extend the entire length of the first support feature 54, one or more portions of the length of the first support feature 54, and/or a combination thereof. In examples with more than one rib 138, the ribs 138 can be spaced at substantially equidistant intervals around the inner surface 134 of the cross-sectional shape. For example, as illustrated in FIG. 5C, the first support feature 54 defining the square cross-sectional shape includes at least one rib 138 on the inner surface 134 of each side of the square. Similarly, as illustrated in FIG. 5D where the cross-sectional shape of the first support feature 54 is a triangle, the inner surface 134 of each side of the triangle can define at least one rib 138.

Referring to FIGS. 4-5D, various exemplary configurations of the first support feature 54 are illustrated. These configurations are merely exemplary, such that additional configurations of the first support feature 54 are contemplated without departing from the teachings herein. Additionally, while the first support feature 54 is illustrated and described, the same description and configurations are applicable to the second support feature 58. Moreover, each of the different cross-sections of the first and second support features 54, 58 may provide different benefits. For example, the cross-section illustrated in FIG. 5B may optimize aspects of the first and second support features 54, 58. The cross-section illustrated in FIG. 5C may provide a convenient configuration for use in the packaging assembly 10.

Referring to FIGS. 1-5D, the first and second support features 54, 58 generally extend the entire length of the first shock-absorbing member 18 and are arranged parallel to one another proximate the side surfaces 106, 110 of the first shock-absorbing member 18. The first and second support features 54, 58 may be advantageous for withstanding forces acting upon the packaging assembly 10 during the shipment and/or distribution processes. For example, the first and second support features 54, 58 can withstand clamping forces applied by machinery that transports the combination of the appliance 14 and the packaging assembly 10. The forces can be applied on opposing sides, either in the length direction or the width direction, of the appliance 14.

According to various aspects, a critical force $F_{cr}$ can be calculated for each of the first and second support features 54, 58. The critical force $F_{cr}$ is the applied force at which a column (e.g., the first or second support feature 54, 58) buckles. The critical force $F_{cr}$ can differ based on, for example, the cross-sectional shape, the size dimensions, and/or the WPC material of the first or second support feature 54, 58. The critical force $F_{cr}$ can be calculated using Euler's formula. Euler's formula is illustrated by the Equation (I):

$$F_{cr} = \frac{\pi^2 EI}{(\mu L)^2}, \tag{I}$$

where $F_{cr}$ is the critical force; E is the elasticity modulus, which depends on the WPC material; I is the inertia moment, which depends on the cross-sectional area (CSA); μ is the length coefficient; and L is the length. Euler's formula predicts a critical buckling load of a long column with pinned ends, which can be applied to the first and second support features 54, 58. For a square cross-sectional shape, the inertia moment I can be calculated using Equation (II):

$$I = \frac{(A^4 - a^4)}{12}, \tag{II}$$

where A is a length of an outer surface 142 of a side of one of the first or second support features 54, 58, and where a is a length of the inner surface 134 of the same side, as best shown in FIG. 5C. For a circular cross-sectional shape, the inertia moment I can be calculated using Equation (III):

$$I = \frac{\pi(D^4 - d^4)}{64}, \quad \text{(III)}$$

where D is a diameter defined by the outer surface 142 of the first or second support feature 54, 58, and where d is a diameter defined by the inner surface 134, as best shown in FIG. 5B. Further, in non-limiting examples, the length coefficient μ may be in a range of from about 0.5 to about 2. In a specific example, the length coefficient μ for the first and second support features 54, 58 may be 0.5.

Adjusting various aspects of the first and second support features 54, 58 can provide for differing critical forces $F_{cr}$ that the first and second support features 54, 58 can withstand. In non-limiting examples, the first and second support features 54, 58 each have a square cross-sectional shape. In a specific example, the first and second support features 54, 58 can have a length defined by the outer surface 142 A of 29.4 mm, a length defined by the inner surface 134 a of 21.2 mm, a thickness of 4.1 mm, a length of 800 mm, and a CSA of 415 $mm^2$. In such examples, the inertia moment I of 45427 $mm^4$. In this configuration, the first and second support features 54, 58 can withstand a critical force $F_{cr}$ is 1900 pounds of force (lbf). It is contemplated that this configuration may be used as a baseline for adjustments to various aspects of the first and second support features 54, 58.

In additional or alternative non-limiting examples, the first and second support features 54, 58 each have a circular cross-sectional shape. In a specific example, the first and second support features 54, 58 can have a diameter defined by the outer surface 142 D of 30.1 mm, a diameter defined by the inner surface 134 d of 23.1 mm, a thickness of 3.5 mm, a length of 800 mm, and a CSA of 293 $mm^2$. In such examples, the inertia moment I is 26374 $mm^4$. In this configuration, the first and second support features 54, 58 can withstand a critical force $F_{cr}$ of 1103 lbf. This configuration may provide an optimized thickness and length with respect to achieving an advantageous critical force $F_{cr}$ value.

Based on the selected configuration, the critical force $F_{cr}$ may be in a range of from about 875 lbf to about 1900 lbf. In a specific example, an optimized critical force $F_{cr}$ may be about 1100 lbf. The critical force $F_{cr}$ of 1100 lbf may be a bearing pressure applied in a length direction of the first and second support features 54, 58. Additionally, the overall deformation of the first and second support features 54, 58 during loading may be less than 0.5%. It is contemplated that the data relating to the force calculation is merely exemplary and is not limiting. The force calculation may be adjusted based on a variety of factors, including, but not limited to, the size, the shape, and the material of the first and second support features 54, 58.

Figure 6:
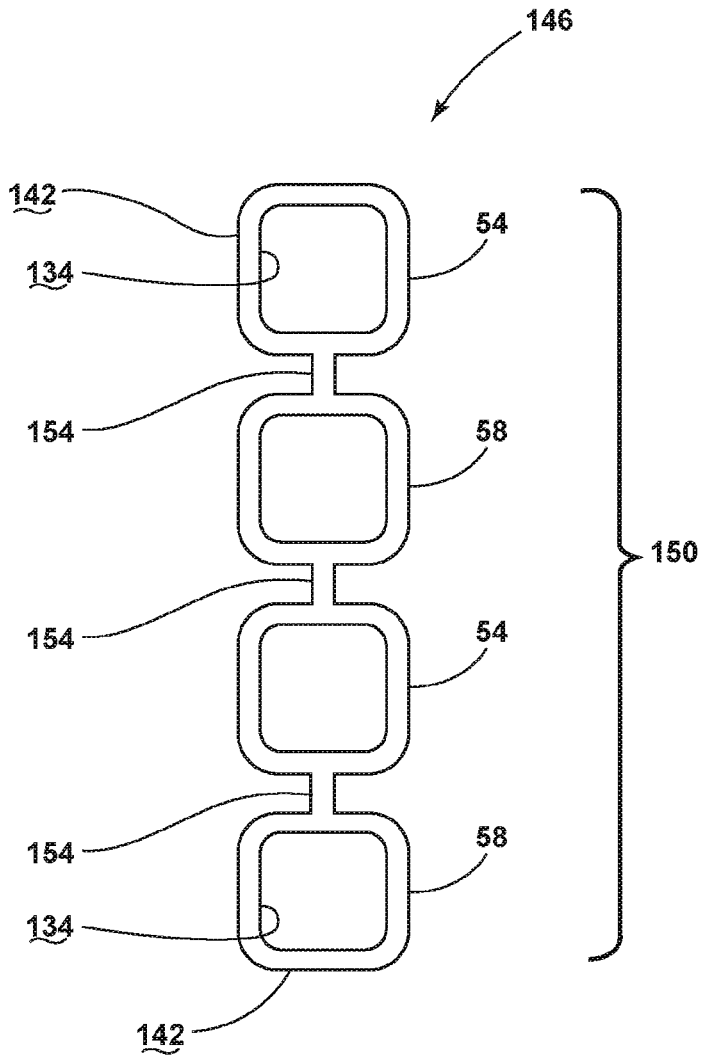
FIG. 6 is a side elevational cross-sectional view of a plurality of support features, according to the present disclosure.

Referring to FIG. 6, a plurality of support features 146 may be formed substantially concurrently through an extrusion process. The plurality of support features 146 may include any practicable number of individual support features 150 (e.g., first and/or second support features 54, 58). In examples where the individual support features 150 define corners or edges (e.g., square, triangle, etc.), the edges of each individual support feature 150 may be radiused or rounded. As illustrated in FIG. 6, for individual support features 150 are extruded at substantially the same time in a parallel configuration. Adjacent individual support features 150 can be connected to one another via a connector 154. The connectors 154 may have any practicable width and length based on the configuration of the individual support features 150. For example, the connectors 154 may have a width of about 6 mm. The connector 154 can extend the entire length of the individual support features 150, or alternatively, a portion thereof. The connector 154 may be centrally located on each of the adjacent individual support features 150.

In a non-limiting example, each connector 154 is disposed in a range of from about 3.5 mm to about 5.5 mm from the radiused edge of each of the individual support features 150. In a specific example, the edges can have a radius of about 6.5 mm. The extrusion of the plurality of support features 146 can provide a continuous production of multiple individual support features 150 simultaneously. The extrusion process may reduce manufacturing costs and time.

In another non-limiting example, the individual support features 150 can each have a square cross-sectional shape with radiused edges. Each individual support feature 150 can have a thickness of about 4.2 mm and define a hollow interior. The distance between each connector 154 and the radiused edge of the adjacent individual support feature 150 may be about 4 mm. The length of the outer surface 142 A is about 25 mm. The inertia moment I may be about 47491 $mm^4$, and the critical force $F_{cr}$ is about 1600 pounds. The length of the plurality of support features 146 combined with the connectors 154 is about 149 mm.

In an additional or alternative non-limiting example, each individual support feature 150 can have a thickness of about 3.5 mm and define a hollow interior. The distance between the connector 154 and the radiused edge of the adjacent individual support feature 150 may be about 5.25 mm. The length of the outer surface 142 A is about 27 mm. The inertia moment I may be about 27932 $mm^4$, and the critical force $F_{cr}$ may be about 1190 pounds. The length of the plurality of support features 146 combined with the connectors 154 is about 159 mm.

Figure 7:
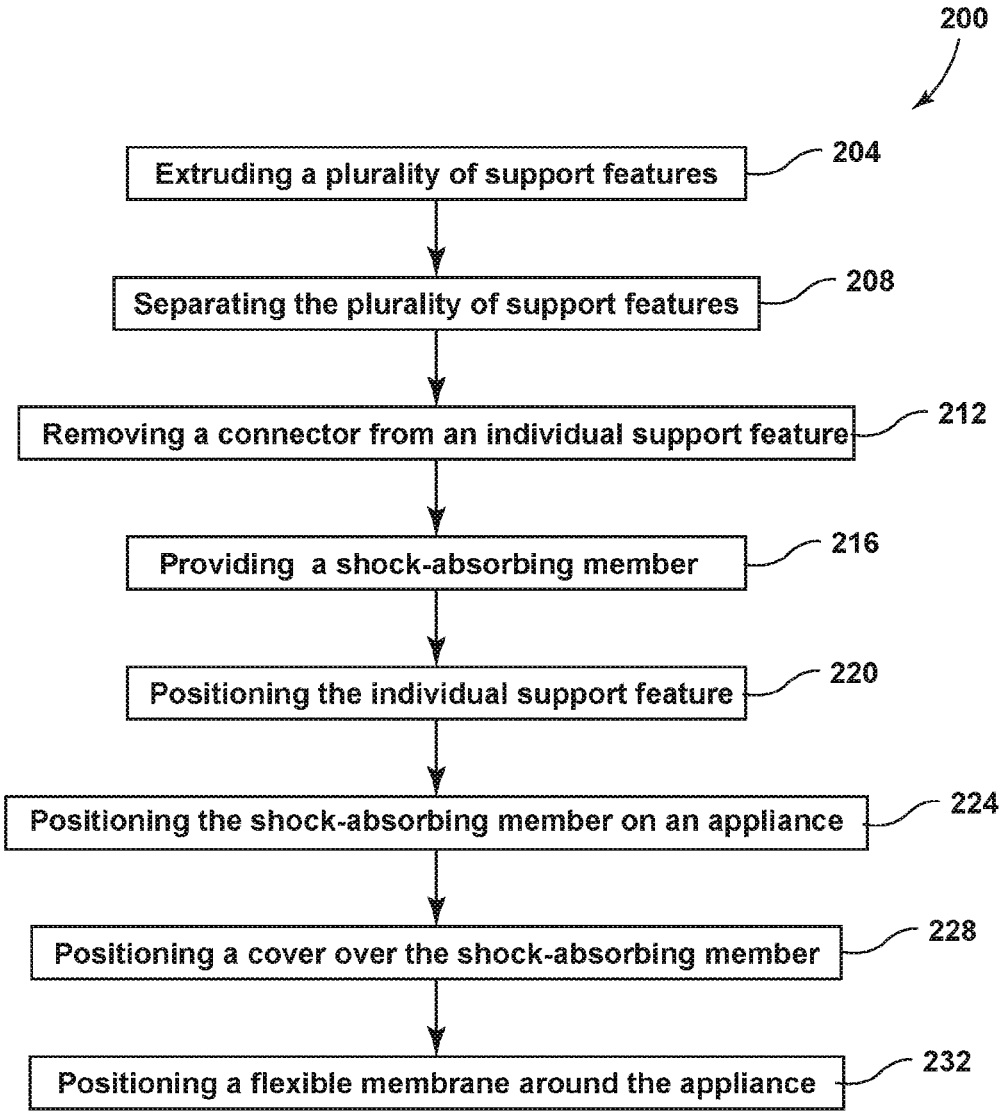
FIG. 7 is a flow diagram of a method for packaging an appliance, according to the present disclosure.

Referring to FIG. 7, and with further reference to FIGS. 1-6, a method 200 of packaging the appliance 14 includes step 204 of extruding the plurality of support features 146. The plurality of support features 146 can be extended in a parallel configuration. The adjacent individual support features 150 may be coupled together by the connectors 154. Any number of individual support features 150 can be included in the plurality of support features 146 that are extruded concurrently.

In step 208, the plurality of support features 146 can be separated into the individual support features 150. The individual support features 150 can be separated using any practicable method. Each connector 154 can be separated from one or both of the individual support features 150 that the connector 154 extends between. Additionally or alternatively, the connector 154 can be divided, such that a portion of each connector 154 remains coupled to each of the adjacent individual support features 150.

In step 212, the connector 154 is removed from each of the individual support features 150. Accordingly, if all or a portion of the connector 154 remains connected to an individual support feature 150 after separation, the connector 154 may be fully removed. The connector 154 may extend the entire length of the individual support features 150, or alternatively may extend a portion or in discrete portions of the length of the individual support feature 150.

In step 216, the first shock-absorbing member 18 is provided. The first shock-absorbing member 18 can define at least one of the first and second grooves 30, 34. The first and/or second grooves 30, 34 can correspond with the cross-sectional shapes of the individual support features 150 that were extruded as part of the plurality of support features 146.

In step 220, the individual support features 150 are positioned within the first and second grooves 30, 34 of the first shock-absorbing member 18. In step 224, the first shock-absorbing member 18 can be disposed on the top 26 of the appliance 14. Additionally, in step 224, the appliance 14 can be disposed in the recess 46 of the second shock-absorbing member 42. In step 228, the cover 122 can be positioned over the first shock-absorbing member 18 and the individual support features 150 disposed within the first and second grooves 30, 34.

In step 232, the flexible membrane 126 can be positioned around the appliance 14. The flexible membrane 126 may extend around the first shock-absorbing member 18, the cover 122, the appliance 14, and the second shock-absorbing member 42. Further, in step 232, the flexible membrane 126 can be adjusted to be form fit around the components disposed therein. Additionally, in step 232, the appliance 14 and the packaging assembly 10 can be positioned within the shipping receptacle 130. The shipping receptacle 130 can be sealed, such that the appliance 14 may be ready for shipment or distribution.

Use of the present disclosure may provide for a variety of advantages. For example, the first and second support features 54, 58 can withstand bearing pressure in the length direction of more than about 1100 pounds, which can be applied by machinery during the shipping and distribution processes. Moreover, the overall deformation of each of the first and second support features 54, 58 during loading by machinery may be less than 0.5%. Further, each of the first and second support features 54, 58 can be constructed of WPC. The WPC may have increased compression strength and humidity non-sensitivity. Additionally, the WPC can be increased stability and have a controlled strength with low variation. The WPC may also reduce material usage and can be environmentally friendly. Also, the first and second support features 54, 58 can be extruded as part of the plurality of support features 146 (e.g., the individual support features 150). The extrusion of the plurality of support features 146 can provide multiple individual support features 150, concurrently, through a continuous process. The extrusion process may also reduce manufacturing time and costs. Additional benefits or advantages of using this device may also be realized and/or achieved.

The device disclosed herein is further summarized in the following paragraphs and is further characterized by combinations of any and all of the various aspects described therein.

According to one aspect of the present disclosure, a packaging assembly for an appliance includes a first shock-absorbing member that defines a cavity to receive a top of the appliance. The first shock-absorbing member defines a first groove and a second groove. Each of the first groove and second groove is defined in a top surface of the first shock-absorbing member and extend along a length thereof. A second shock-absorbing member defines a recess to receive a bottom of the appliance. The first shock-absorbing member and the second shock-absorbing member are configured to retain the appliance. A first support feature is disposed within the first groove of the first shock-absorbing member. A second support feature is disposed within the second groove of the first shock-absorbing member. Each of the first support feature and the second support feature is constructed of a wood plastic composite.

According to another aspect, a first groove and a second groove extend along opposing edges of a first shock-absorbing member adjacent to corresponding side surfaces.

According to still another aspect, each of a first support feature and a second support feature extends an entire length of a first shock-absorbing member.

According to yet another aspect, a cover is disposed over a first shock-absorbing member, a first support feature, and a second support feature.

According to another aspect, a shape of each of a first groove and a second groove corresponds with a cross-sectional shape of a first support feature and a second support feature, respectively.

According to still another aspect, a cross-sectional shape is at least one of a square, a triangle, a circle, and an I-shape.

According to yet another aspect, each of a first support feature and a second support feature is hollow. An inner surface of each of the first support feature and the second support feature defines a rib extending along a length thereof, respectively.

According to another aspect, a flexible membrane is disposed around a first shock-absorbing member and a second shock-absorbing member.

According to another aspect of the present disclosure, a packaging assembly includes a shock-absorbing member that defines a first groove along a first edge and a second groove along a second edge. Each of the first groove and the second groove extend along a length of the shock-absorbing member. The shock-absorbing member defines a cavity for receiving an appliance. A first support feature is disposed within the first groove. A second support feature is disposed within the second groove. The first support feature and the second support feature are constructed of a wood plastic composite.

According to another aspect, each of a first support feature and a second support feature is hollow. An inner surface of each of the first support feature and the second support feature defines a plurality of ribs.

According to still another aspect, each of a first support feature and a second support feature defines a cross-sectional shape. The cross-sectional shape is at least one of a square, a triangle, a circle, and an I-shape.

According to yet another aspect, a wood plastic composite includes a polymer resin in a range of from about 25% to about 40% and a wood fiber in a range of from about 40% to about 70%.

According to another aspect, a polymer resin includes at least one of polyethylene, high-density polyethylene, polyvinyl chloride, polypropylene, and acrylonitrile butadiene styrene.

According to another aspect, a wood fiber includes at least one of pulp, peanut hulls, bamboo, and straw.

According to another aspect, a wood plastic composite includes a mineral filling. The mineral filling is at least one of calcium carbonate and talcum powder.

According to another aspect, a wood plastic composite includes less than or equal to about 20% of a mineral filling.

According to still another aspect, a wood plastic composite includes an additive. The additive is at least one of an antioxidant, a plasticizer, a coupling agent, and a color powder.

According to another aspect, a wood plastic composite includes an additive in a range of from about 1% to about 5%.

According to yet another aspect, a cover is disposed over a shock-absorbing member, a first support feature, and a second support feature.

According to another aspect, a first groove and a second groove are defined in a top surface of a shock-absorbing member.

According to another aspect, a method of packaging an appliance including a packaging assembly of any and all of the various aspects described herein.

According to another aspect of the present disclosure, a method of packaging an appliance includes extruding a plurality of support features arranged in a parallel configuration. Adjacent support features are coupled together by a connector. The plurality of support features is separated into individual support features. A shock-absorbing member that defines a groove is provided. An individual support feature is positioned within the groove.

According to still another aspect, a connector is removed from an individual support feature.

According to yet another aspect, a shock-absorbing member is positioned on an appliance. A flexible membrane is positioned around the shock-absorbing member and the appliance.

According to another aspect, a cover is positioned over a shock-absorbing member and an individual support feature.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A packaging assembly for an appliance, comprising:

a first shock-absorbing member defining a cavity to receive a top of said appliance, wherein the first shock-absorbing member defines a first groove and a second groove, each of the first groove and the second groove defined in a top surface of the first shock-absorbing member and extending along a length thereof;

a second shock-absorbing member defining a recess to receive a bottom of said appliance, wherein the first shock-absorbing member and the second shock-absorbing member are configured to retain said appliance;

a first support feature disposed within the first groove of the first shock-absorbing member;

a second support feature disposed within the second groove of the first shock-absorbing member, wherein each of the first support feature and the second support feature is constructed of a wood plastic composite, defines a hollow interior, and has elongated ribs extending along a length of an inner surface within the hollow interior, and wherein the elongated ribs are positioned at intervals around the hollow interior and extend toward a center of the hollow interior with distal ends of the elongated ribs spaced from the inner surface, each of the first and second support features having a plurality of planes of symmetry along a cross-section and crossing through at least one elongated rib; and elongated support members extending along an outer surface of the second shock-absorbing member from a first corner to a second corner and perpendicular to the first and second support features.

2. The packaging assembly of claim 1, wherein the first groove and the second groove extend along opposing edges of the first shock-absorbing member adjacent to corresponding side surfaces.

3. The packaging assembly of claim 1, wherein each of the first support feature and the second support feature extend an entire length of the first shock-absorbing member.

4. The packaging assembly of claim 1, further comprising:

a cover disposed over the first shock-absorbing member, the first support feature, and the second support feature.

5. The packaging assembly of claim 4, wherein the first support feature and the second support feature fill the first groove and the second groove, respectively, to align with at least one of the top surface and a respective side surface of the first shock-absorbing member to engage the cover.

6. The packaging assembly of claim 1, wherein a shape of each of the first groove and the second groove corresponds with a cross-sectional shape of the first support feature and the second support feature, respectively.

7. The packaging assembly of claim 6, wherein the cross-sectional shape is at least one of a square, a triangle, a circle, and an I-shape.

8. The packaging assembly of claim 1, further comprising:

a flexible membrane disposed around the first shock-absorbing member and the second shock-absorbing member.

9. The packaging assembly of claim 1, wherein the wood plastic composite is formed from at least a combination of a polymer resin and a biomass filling, and wherein the first and second support features are configured to withstand greater than 1100 pounds of force in a length direction.

10. The packaging assembly of claim 1, wherein the elongated support members are configured to extend along a width of said appliance with longitudinal extents thereof extending perpendicular to the first and second support features having longitudinal extents thereof configured to extend along a length of said appliance.

11. The packaging assembly of claim 1, wherein the elongated support members extend along a bottom surface and cover opposing side surfaces, respectively, of the second shock-absorbing member.

12. The packaging assembly of claim 1, wherein the wood plastic composite has a total composition of 100%, and wherein the total composition of 100% includes:

a polymer resin in a range of from about 25% to about 40%;

a wood fiber in a range of from about 40% to about 70%;

a mineral filling less than or equal to about 20%; and an additive in a range of from about 1% to about 5%.

13. The packaging assembly of claim 1, wherein each of the first and second support features defines a geometric cross-sectional shape defined by sides coupled via radiused corners.

14. The packaging assembly of claim 1, further comprising:

platforms disposed on an inner surface of the second shock-absorbing member to space the bottom of said appliance from the inner surface.

15. The packaging assembly of claim 1, wherein the first and second support features define at least one of a circular cross-sectional shape and an oblong cross-sectional shape, and wherein the first and second grooves are rounded to receive the first and second support features.

16. The packaging assembly of claim 1, wherein the elongated ribs are integrally formed with the first and second support features, respectively.

17. The packaging assembly of claim 1, wherein the first shock-absorbing member is a single continuous piece configured to extend from a first side of the top of said appliance to a second side of the top of said appliance and configured to extend beyond side edges and along side surfaces on each side of said appliance to have a greater length and width than said appliance, and wherein the first groove and the second groove extend along opposing edges of the first shock-absorbing member adjacent to corresponding side surfaces, the first and second grooves extending from one end surface to an opposing end surface of the first shock-absorbing member.

18. The packaging assembly of claim 1, wherein at least one end surface of the first shock-absorbing member defines an indent that extends from a bottom edge of the first shock-absorbing member to form a grasping location.

19. The packaging assembly of claim 1, wherein the elongated ribs are arranged at equal intervals around the hollow interior.

20. The packaging assembly of claim 1, wherein each end surface of the first shock-absorbing member defines an indent extending along a width of the first shock-absorbing member to form grasping locations, and wherein the top surface of the first shock-absorbing member defines receiving spaces between the first and second grooves to support appliance accessories.

* * * * *